United States Patent [19]

Flugger

[11] 4,220,219

[45] Sep. 2, 1980

[54] LIGHTWEIGHT MUFFLER AND METHOD FOR MUFFLING NOISE

[76] Inventor: Ray T. Flugger, 4810 Roblar Rd., Petaluma, Calif. 94952

[21] Appl. No.: 942,406

[22] Filed: Sep. 14, 1978

[51] Int. Cl.[2] ..... F01N 1/08

[52] U.S. Cl. ..... 181/265; 181/268; 181/272; 181/275; 181/281

[58] Field of Search ..... 181/255, 264–269, 181/272–276, 279–281, 231; 138/40, 42, 43, 46; 55/276, 325, 326, 391, 392, 413, 414, 426, 446, DIG. 20, DIG. 30

[56] References Cited

U.S. PATENT DOCUMENTS

| | | | |
|---|---|---|---|
| 756,203 | 4/1904 | Barthel | 181/269 |
| 992,344 | 5/1911 | Donohue | 181/264 |
| 1,051,130 | 1/1913 | Lattime et al. | 181/283 X |
| 1,131,233 | 3/1915 | Gorosa | 181/265 |
| 1,338,520 | 4/1920 | Moores | 181/253 |
| 1,553,264 | 9/1925 | Reasonover | 181/254 |
| 1,677,570 | 7/1926 | Stade | 181/269 |
| 1,698,842 | 8/1926 | Estep | 181/264 |
| 1,732,818 | 11/1927 | Oldberg | 181/264 |
| 1,820,972 | 9/1931 | Haas | 181/264 |
| 1,842,921 | 1/1932 | Dyke | 181/274 |
| 2,109,220 | 2/1938 | Noblitt et al. | 181/266 |
| 2,146,183 | 2/1939 | Hector | 181/266 |
| 2,150,811 | 3/1939 | Starkweather et al. | 181/266 |
| 2,196,920 | 4/1940 | Hoyle | 181/231 |
| 2,325,905 | 8/1943 | Caulfield | 181/268 |
| 2,675,088 | 4/1954 | McLeod | 181/265 |
| 3,017,948 | 1/1962 | Shepherd et al. | 181/277 |
| 3,036,655 | 5/1962 | Powers | 181/266 |
| 3,324,634 | 6/1967 | Brahler et al. | 55/337 |
| 3,361,227 | 1/1968 | Kaari | 181/265 |
| 3,480,105 | 11/1969 | Burris | 181/255 |
| 3,498,406 | 3/1970 | Heath | 181/265 |
| 3,642,094 | 2/1972 | Yancey | 181/265 |
| 3,710,891 | 1/1973 | Flugger | 181/256 |
| 3,754,620 | 8/1973 | Foster et al. | 181/265 |
| 3,786,897 | 1/1974 | Swanson | 181/266 |

FOREIGN PATENT DOCUMENTS

| | | | |
|---|---|---|---|
| 1043396 | 11/1953 | France | 181/265 |
| 1098710 | 8/1955 | France | 181/265 |

*Primary Examiner*—L. T. Hix
*Assistant Examiner*—Benjamin R. Fuller
*Attorney, Agent, or Firm*—Warren, Chickering & Grunewald

[57] ABSTRACT

A lightweight muffler and method for muffling a noise component of a stream of gases is disclosed. The muffler includes a chamber in which gases are directed side-by-side streams flowing in opposite directions. The streams are in contact with each other for the generation of sound dampening eddy currents in the chamber, but such contact does not break down the continuous, low resistance flow of gases through the muffler. The chamber is advantageously formed as an expansion chamber in which gases: enter one end of the chamber as an annular stream concentric with the inlet pipe to the muffler, travel along the inlet pipe to the other end of the chamber, are reversed, and travel as a concentric annular stream of greater diameter in the opposite direction down the length of the chamber for discharge into a passageway leading to the outlet tube of the muffler. A second similarly formed chamber for counterflow of opposed streams and the generation of eddy current therebetween is preferably formed proximate the outlet tube of the muffler.

10 Claims, 4 Drawing Figures

LIGHTWEIGHT MUFFLER AND METHOD FOR MUFFLING NOISE

BACKGROUND OF THE INVENTION

Considerable effort has been directed over the years in connection with attempting to optimize the design of mufflers for internal combustion engines or similar applications in which there is a flow of gases having a noise component entrained or accompanying the gases. There are many factors which come into play in determining whether or not a particular muffler design is a success, but perhaps the four most commonly considered factors are size, weight, back pressure and, of course, noise reduction. If size, weight and back pressure were not considerations, mufflers could be devised which would reduce the noise level to essentially nill. Size, and even more importantly weight, are almost always important considerations in muffler design. In the current effort to obtain better mileage from automobiles, manufacturers are most interested in reducing muffler weight, as part of the overall effort to reduce the weight of the automobile. While in many automobiles the size of the muffler may not be as critical, reductions in size, give the engineers greater flexibility in the positioning of the muffler and in its use on other internal combustion engines, such as motorcycles and the like.

Existing mufflers have attained a noise reduction level which is satisfactory for today's requirements, but federal standards as to the noise level which will be tolerated from automobile exhaust are being increased in a fashion which parallels the increase in standards as to the reduction of pollutants which will be tolerated from exhaust systems. The solution to the increasing standards as to noise levels cannot be based upon adding to the muffler complexity, weight and size. Additionally, reductions in noise level and in muffler weight cannot be achieved at the expense of driving up the back pressure on the engine, since increased back pressure decreases engine efficiency and will defeat the effect of any weight savings achieved in the muffler. Thus, what is needed is a lightweight muffler having enhanced noise reduction and yet decreased (or not greater) resistance to flow through the muffler. Such a muffler further would desirably be a smaller size.

Prior art muffler designs include various combinations of reoccurring noise muffling structures. Perhaps the broadest and most common of these structures is to provide a circuitous or tortuous path for the flow of exhaust gases through the muffler. Typical of patents in which such a circuitous path is provided, usually by partitions or the like, are the following U.S. Pat. Nos.: 3,642,094, 3,036,655, 2,150,811, 2,109,220, 1,338,520, 1,131,233 and 756,203. These patents generally incorporate structures in which there are reversals of the direction of flow of the exhaust gases as part of the circuitous path, and in most of these patents the flow of gases is guided by partitions or muffler wall throughout the muffler. Thus, in most of these patents, the gases are not discharged into large expansion chambers where the flow paths are constantly changing and pockets of relatively stationary gases can be found. Thus, unless the flow path is very long or is restricted, this type of muffler usually has the advantage of relatively low resistance or back pressure. Unfortunately, this type of partition guided flow also has the disadvantage of requiring a relatively long path and great number of direction reversals to satisfactorily reduce the level of noise in the gases. Thus, while the gases move in a channelled, relatively controlled manner through the muffler, so does the noise component in the gases.

Another approach which is found in prior art mufflers is to discharge the exhaust gases from an inlet tube against a transverse partition or into a cup or bucket-like expansion chamber. Typical of these prior art mufflers is my previous U.S. Pat. No. 3,710,891 in which exhaust gases are directed by a venturi structure against a transverse member and then are deflected laterally into an annular chamber surrounded by sound deadening material. From the annular chamber, they flow axially along the muffler until they can escape through perforations in an outlet tube. Other examples of muffler structures in which the inlet tube is discharged against a transverse partition, cup or into a large expansion chamber are shown in U.S. Pat. Nos. 3,480,105, 2,325,905, 2,146,183, 1,677,570, 1,553,264 and 1,051,130. Such mufflers have the advantage of relatively good sound dampening or reduction, but they tend to achieve sound dampening by the creation of turbulent, ever-changing flow paths and dead spaces, which in turn tend to increase back pressure caused by the muffler.

Another well known technique for sound deadening in a muffler is to attempt to positively induce a swirling component to the flow of gases through the muffler. Typical of such prior mufflers are the following U.S. Pat. Nos.: 3,498,406, 3,324,634, 3,017,948, 1,842,921, 1,732,818 and 1,698,842. As will be apparent from these patents, some also include the discharge into an expansion chamber and the use of circuitous paths. It is also well known that the addition of a turbo charger to an automobile engine will have a noise reduction effect as a result of inducing swirling or rotary motion into the stream of gases. The primary disadvantage of attempting to use swirling or a rotational component to effect sound dampening is that the flow paths are constantly changing and the effect on sound reduction varies substantially with the volume of gases passing through the muffler. Thus, back pressure can build substantially, particularly at high flow rates, and sound reduction can be unsatisfactory. Moreover, some of the swirl inducing structures, and particularly those in which are rotating parts, are undesirably complex and unreliable in their operation.

Still another approach disclosed in prior art patents is the attempt to divide up the flow of gases into a plurality of streams and cause the streams to impinge upon each other during flow through the muffler. Typical of such devices are the mufflers disclosed in U.S. Pat. Nos. 3,361,227, 2,675,088 and 1,820,972. These patents also employ the cup or expansion chamber structure as part of the mechanism employed to divide up the flow of gases into a plurality of streams which are subsequently directed upon each other. This approach is effective in noise reduction, but it also undesirably increases back pressure by employing resistance to divide the streams and by permitting relatively turbulent and uncontrolled flow of the multiple streams in expansion chambers.

Finally, the patent art also discloses mufflers in which flow reversal occurs as a result of discharge of gases against a transverse partition, and the gases further discharge from the partition into a chamber having a dead space in which gases are trapped usually by the convergence of a conical and cylindrical surface. Typical of these prior art devices are the patents described in U.S. Pat. Nos. 3,786,896, 3,754,620, 2,196,920 and 992,344. This type of muffler has the advantage of noise reduction by reason of impingement of the gas stream on the relatively "dead" space, but such constructions also produce an undesirably high back pressure or resistance to flow of gases through the muffler.

OBJECTS AND SUMMARY OF THE INVENTION

A. Object of the Invention

Accordingly, it is an object of the present invention to provide a muffler and method for reducing a muffling noise in a stream of gas which enables noise reduction without adversely increasing the back pressure or resistance to flow of the exhaust gases.

Another object of the present invention is to provide a muffler in which the noise reduction can be increased and the weight and back pressure of the muffler decreased.

Still a further object of the present invention is to provide a muffler for use with an internal combustion engine which is easy and economical to construct and is lightweight and small in diameter.

Still a further object of the present invention is to provide a method for muffling or reducing the noise level in exhaust gases from an internal combustion engine in which the back pressure is minimized at the exhaust gas flow rate most frequently produced by the engine.

Still a further object of the present invention is to provide a lightweight automotive muffler which is durable, economical to manufacture, may be installed as original or replacement equipment, and can be readily matched to the performance of wide range of internal combustion engines.

The lightweight muffler and the method of muffling noise of the present invention have other objects and features of advantage which will be set forth in more detail in the following description of the preferred embodiments and will become apparent from the accompanying drawing.

B. Brief Summary of the Invention

The lightweight muffler of the present invention includes an outer substantially imperforate casing having an inlet opening therein, an outlet opening, and partition means provided inside the casing and defining a flow chamber and passageway between the inlet opening, the chamber and the outlet opening of the muffler. In the improvement of the present invention, the partition is formed for discharge of gases into the chamber in a stream, and the chamber is formed for reversal of the direction of flow of gases and for controlled flow throughout the chamber in a continuous stream with a first portion of the stream flowing in an unrestricted side-by-side flow communication with a second portion of the stream moving in an opposite direction in the chamber for the generation of sound dampening eddy currents between the two oppositely moving stream portions without breaking down the continuous flow in either stream portion. The apparatus preferably is formed for flow of the gases in concentric annular streams moving in opposed directions in the chamber, which acts as an expansion chamber. A second chamber proximate the muffler outlet opening may also advantageously be employed and is constructed for counterflow of annular streams in side-by-side concentric relation.

The method of the present invention is comprised of muffling the noise component entrained in a stream of gas by the steps of directing the flow of gases in a stream into a chamber in a first direction, reversing the direction of flow of the gases, and directing the flow of gases in a stream in an opposite second direction in side-by-side unrestricted contact with the flow of gases in the first direction for the generation of sound deadening eddy currents between the oppositely moving streams without destroying the continuous flow in either of the streams.

DESCRIPTION OF THE PREFERRED EMBODIMENT

The lightweight muffler of the present invention enables a significant reduction in the noise level of exhaust gases from an internal combustion engine while also enabling a reduction in the back pressure to which the engine is subjected. These highly desirable goals are further accompanied by a reduction in the overall size and weight of the muffler.

Figure 1:
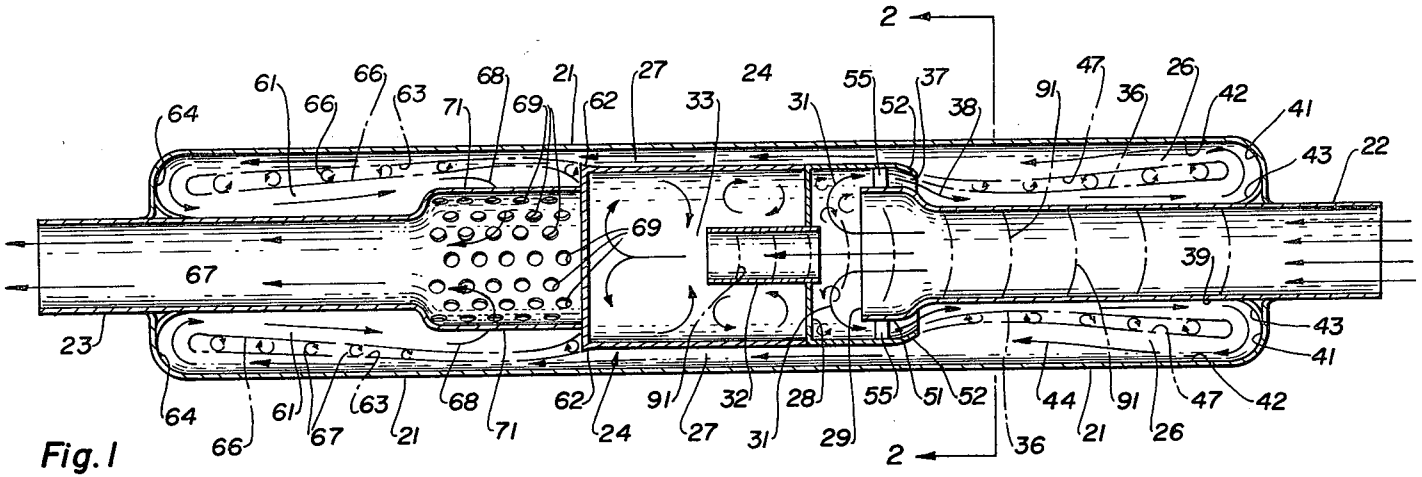
FIG. 1 is a side elevational view, in cross-section of a muffler constructed in accordance with the present invention.
Figure 3:
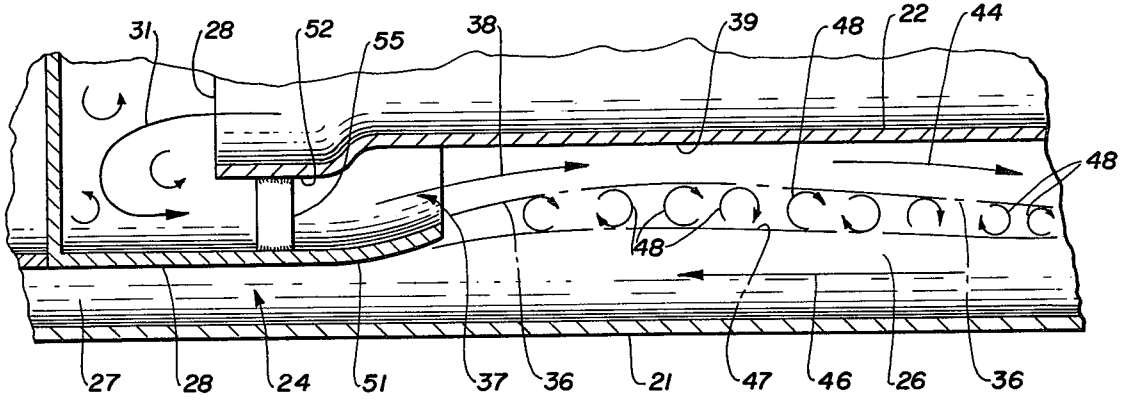
FIG. 3 is an enlarged, fragmentary, side elevational view in cross-section of a portion of the muffler of FIG. 1.
Figure 2:
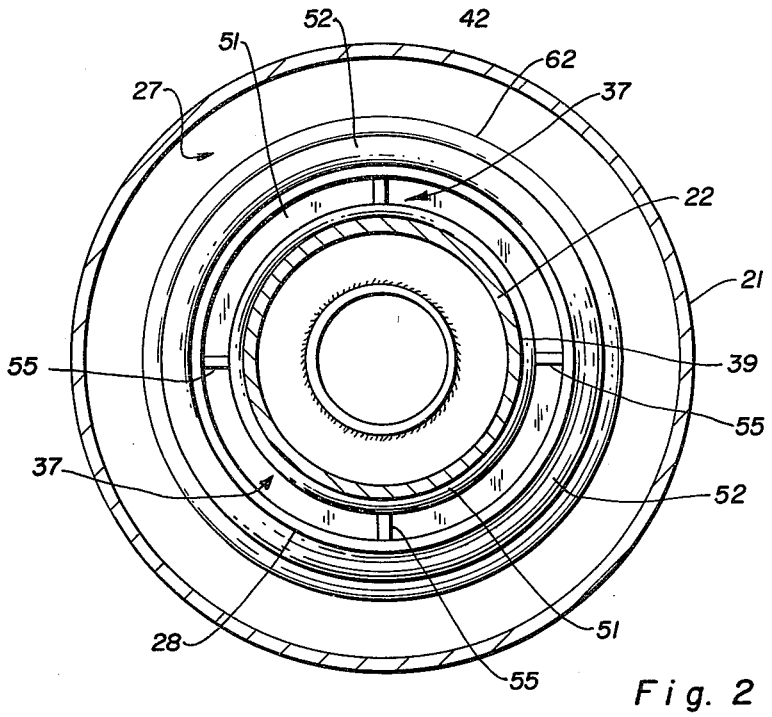
FIG. 2 is an enlarged cross-sectional view taken substantially along the plane of line 2—2 in FIG. 1.

As best may be seen in FIGS. 1 through 3, the lightweight muffler of the present invention includes an outer casing 21, which is substantially imperforate other than having an inlet opening in which inlet tube 22 is mounted and an outlet opening in which outlet tube 23 is mounted. The inlet and outlet openings enable the flow of gases, usually exhaust gases from an internal combustion engine, into casing 21 and out of the casing. Mounted interiorly of casing 21 is partition means, generally designated 24, which is formed to define, with the casing, a flow chamber 26 and passageway means 27 communicating with chamber 26 for the flow of gases through the chamber and out the outlet opening.

More specifically, partition means 24 includes a transversely extending cup-like member 28 positioned immediately in front of the discharge port or outlet 29 of inlet tube 22. Thus, gases discharging from inlet tube 22 will impinge upon cup 28 and have the direction of their flow reversed, as indicated by arrows 31. Partition means 24 further includes a tubular member 32 which provides for communication of gases into a chamber 33, as will be more fully set forth hereinafter. Since chamber 33 is a closed chamber, however, as far as the effect on the flow pattern of the gases, cup 28 essentially acts as a solid transverse partition, and substantially all of the exhaust gases have their direction reversed for flow into chamber 26.

As thus far described, the muffler of the present invention has elements which can be found in prior muffler constructions. It is not uncommon to employ a cup-like partition proximate an inlet tube discharge opening to effect a flow reversal of gases. This discharge of gases into cup 28 creates a turbulence in the cup which combines with the reversal of flow of gases to effect some reduction in the noise component entrained in the exhaust gases.

The improvement in the muffler of the present invention resides in the construction of chamber 26 and the manner in which the exhaust gases are discharged into the chamber. As best may be seen in FIG. 3, partition means 24, in this case cup-like member 28, is formed for discharge of gases into chamber 26 in a stream 36. Stream 36 is shown by a phantom line in FIG. 3 which roughly delineates the radial outermost boundary of stream 36. Cup 28 includes a discharge opening or port 37 from which gases immerge in stream 36 as indicated by arrow 38. As will be seen from FIG. 2, the discharge opening 37 is annular and gases are directed from the discharge opening in an annular stream which is concentric with and is directed against the outside surface 39 of inlet tube 22.

Once stream 36 is in chamber 26, it flows concentrically with inlet tube 22 in a stream until it reaches the end 41 of chamber 26. As shown in the preferred form of the invention, the end of chamber 26 is defined by casing 21 and includes a flow reversal surface that extends from outside surface 39 of the inlet tube to the inside surface 42 of casing 21. As will be seen, the flow reversal surface of 41 is formed by the outside casing and a fillet or internal partition means 43 so as to present a smooth transition from the inlet tube to the outside casing wall. This smooth transition enables a reversal of the flow of the stream in the chamber without breaking up the stream.

In the muffler of the present invention, therefore, an expansion chamber 26 is provided into which exhaust gases are discharged in a stream. The stream has a first portion generally bounded by phantom line 36 which is flowing in a first direction, as indicated by arrow 44. After reversal of the stream, it flows in an opposed second direction, as indicated by arrow 46, and this second portion of the stream is bounded by phantom line 47.

As will be seen from the drawings, first stream portion 36 and second stream portion 47 are not separated by a partition or other divider in chamber 26. Instead, the streams are in side-by-side, unrestricted, flow communication with each other. The end result of providing a counterflow expansion chamber in which the gases are reversed and yet maintained in streams is a substantial reduction in the noise level from the muffler, without increasing the back pressure. It is hypothesized that eddy currents, shown by arrows 48, are generated between the oppositely moving streams and that these eddy currents act as a significant noise dampening mechanism in chamber 26.

It is extremely important, however, that the flow of gases in chamber 26 be maintained as a stream. If gases are simply discharged into an expansion chamber in a turbulent or swirling manner, effective noise dampening results, but back pressure is dramatically increased. The chamber of the present invention has the back pressure characteristics which might be expected if a partition were to extend between the stream portions 36 and 47. If such a partition were placed between the stream portions, however, the beneficial effects of the eddy currents 48 in dampening sound would be lost. Accordingly, the muffler of the present invention provides a chamber in which eddy currents are generated and used to effect sound dampening and yet the flow of gases is substantially maintained as a stream throughout the muffler for minimum resistance or back pressure.

In order to assist in the eventual discharge of exhaust gases into chamber 26 in a stream, it is preferable for inlet tube 22 to be formed with an expansion section 51, which tends to start divergence and deceleration of the gases prior to impinging upon cup 28. As will be appreciated, the divergence and deceleration in expansion section 51 is assisted by the fact that the turbulent gases hitting cup 28 build up some resistance during the process of flowing back around the inlet tube.

While turbulence is generated in the cup 28, the cup-like member 28 is preferably further formed to minimize the turbulence in the gases discharged into chamber 26. This can be accomplished by providing the cup with a passageway which terminates in a convergently tapered section 52 having a reduced annular area so as to act like an annular nozzle that eliminates any substantial velocity components in the gases lateral to the stream discharged into chamber 26. As will be seen, inlet tube 22 has the end thereof telescoped into cup-like member 28 and supported in fixed spaced relation thereto by spacer elements 55. The convergently or inwardly tapered section 52 cooperates with the outside surface of expansion section 51 in the formation of the first annular stream portion 36. Perforations in inlet tube 22 in advance of cup 28 would introduce streams of gases into chamber 26, and accordingly, the inlet tube should be imperforate to avoid breaking down stream 36.

As the annular stream 36 discharges into chamber 26, some lateral expansion of the stream occurs since there is no partition or other restriction preventing expansion. It is this expansion and the side-by-side contact between the oppositely flowing streams that generates eddy currents 48. As the stream 36 hits end wall 41 for flow reversal, there is a tendency to again compress the stream against the end wall until the directional flow has been reversed and the stream is flowing in an opposite direction as an annular second stream portion 47 concentric with and surrounding first stream portion 36. The annular second stream portion 47 proceeds along the inside surface of casing 21 toward cup member 28, where the tapered section 52 helps direct stream 47 into annular passageway 27 along the inside of the casing at the middle of the muffler.

Although it is possible simply to discharge gases from passageway 27 into an outlet tube or the like, it is preferable in the muffler of the present invention to provide a second chamber 61 into which gases are discharged from passageway 27 prior to flowing out outlet tube 23. In the preferred form of the invention, chamber 61 is also provided as a counterflow chamber in which opposed streams of gases are set up and maintained, with the eddy currents generated between the oppositely moving streams being used to effect further sound reduction, dampening or muffling.

As may be seen in FIG. 1, a slight divergent taper or deflection means 62 is provided at the end of passageways 27 which discharges into chamber 61. This outward taper has the effect of concentrating or focusing the gases into an annular stream 63 proximate the inside surface of outer casing 21. A flow reversal surface 64 is provided at the end of chamber 61, and gases then proceed in an annular stream 66 about the outside surface of outlet tube 23 in a direction opposite to the direction at which they entered chamber 61. Since there is no partition or other restriction between the two oppositely flowing stream portions, eddy currents 67 are generated between the streams and provide substantial noise level reduction. Flow in chamber 61 is continued until the gases pass, as indicated by arrow 68, through perforations 69 in the enlarged end 71 of the outlet tube. Again, the maintenance of the gases in a stream through chamber 61 avoids the problem of undesirable back pressure build up while employing eddy currents as a sound dampening mechanism.

Figure 4:
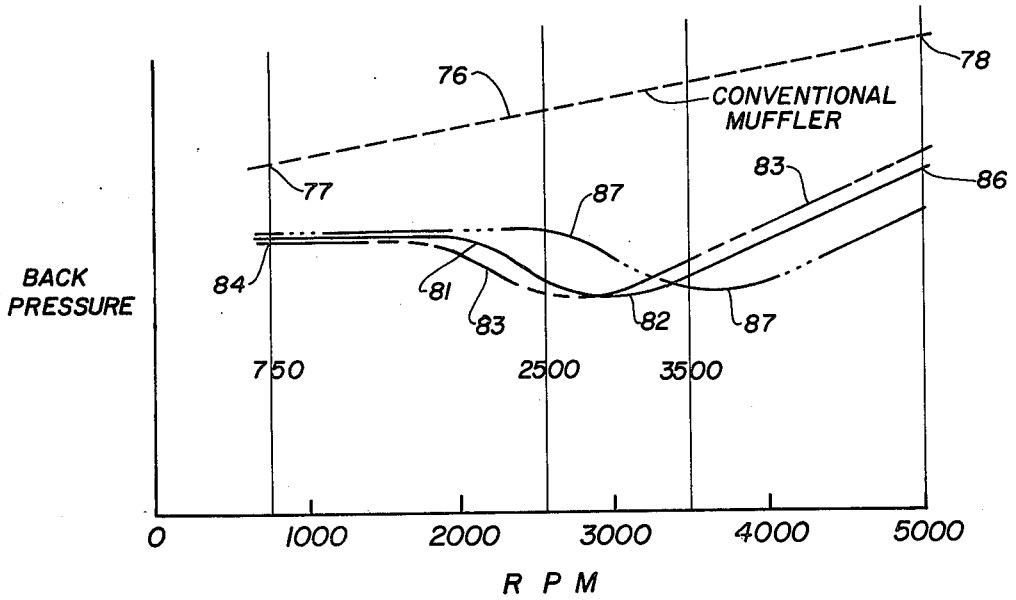
FIG. 4 is a schematic representation of performance of the muffler of FIG. 1.

Performance of the muffler of the present invention can be further examined by reference to FIG. 4. As will be seen, four curves are shown in which back pressure has been plotted as a function of rpm. The uppermost curve 76 represents a "generalized" curve that is typical of "conventional" mufflers. Obviously, there is some variation between brands of mufflers, but generally speaking the curve 76 represents a typical muffler as would be employed in original equipment on a passenger car. As will be seen, the curve is in fact a straight line that increases steadily from idling engine speed at 77 to maximum engine speed at 78. As the rpm increases, the flow through a conventional muffler increases and the back pressure or resistance generated by the muffler similarly increases. As will be understood, some engines have a higher top speed than 5,000 rpm, but the curve for back pressure induced by the muffler would simply continue to rise as rpm rises.

The solid line curve 81 in FIG. 4 represents a typical back pressure versus rpm curve for the muffler of the present invention. Curve 81 represents the type of curve which would be generated under steady state conditions at each rpm or under only moderate acceleration. Under hard acceleration, minimum back pressure point 82 would be shifted to the left, as for example as shown by phantom line curve 83. As will be seen from either of curves 81 or 83, the muffler of the present invention initially has a back pressure 84 at idling speed that is lower than for a conventional muffler. Moreover, the back pressure remains essentially constant as engine speed increases until about 2,000 rpm. When the engine speed reaches 2,000 rpm, the back pressure starts to drop, reaching low point 82 at about 3,000 rpm. Beyond the low point, the back pressure curve begins to rise, but at maximum engine speed back pressure 86 is still substantially below the back pressure 84 for a conventional muffler.

The reason for the drop in back pressure in the muffler of the present invention can be understood by considering the type of flow through the muffler, and particularly chamber 26, as a function of the volume of gases generated at any engine speed. When an engine is idling, the volume through the muffler is relatively low. Under this condition, the gases enter the muffler in spurts or relatively discrete volumes, and these volumes are somewhat spaced apart from each other. In the muffler of the present invention this low flow at idle speed tends to generate more turbulence in cup 28 and more turbulence in chamber 26. In fact, it is hypothesized that the streams 36 and 47 may even periodically break down as a result of the sporadic volumetric flow of gases into the chamber. Such a break down of the streams in chamber 26 has the highly desirable effect of good sound dampening, but it would produce excessive back pressure, if it were not for the fact that the next burst or volume of gases will come soon enough so that the flow through chamber 26 readily resumes the stream pattern.

As the engine speed increases, the spacing between discrete volumes of gases decreases, and the streams 36 and 47 are well established in chamber 26. This clear establishment of the streams in chamber 26 is accompanied by a drop in back pressure over the somewhat turbulent condition in chamber 26 that occurs during idling. As the engine speed is increased further, however, the volume becomes great enough so that back pressure begins to increase, but it still is well below a conventional muffler.

The performance of back pressure is a function of engine speed, shown in FIG. 4, and its relationship to counterflow chamber 26 demonstrates a method by which the muffler of the present invention can be used to enhance engine performance. It is not undesirable to have a back pressure at engine idling speed which is somewhat elevated. The back pressure produced by a muffler at idling helps smooth out the engine performance at low speeds. As the engine speed increases, however, back pressure simply reduces the efficiency of performance of the engine. If highway cruising speed for a typical automobile might be achieved at an engine speed of between 2500–3500 rpm, this is the range at which the muffler back pressure is desirably minimized. This will cause the engine to have greater efficiency at the normal or most used cruising speed, with attendant energy savings.

Accordingly, the method of the present invention contemplates control of the volume of chamber 26 so as to minimize the back pressure created by the muffler at a given gas flow rate and temperature. In most cases the given flow rate and temperature would be that normally expected to occur at operating speeds of the engine most used and when the engine is under steady state conditions. If, for some reason, maximum efficiency was desired under hard acceleration, in which the gas temperatures are higher and accordingly volume somewhat greater, the chamber could be selected so as to produce the minimum at the desired hard acceleration engine speed. In FIG. 4, this could be at approximately 2500 rpm, in accordance with curve 83. Under steady state conditions the minimum would occur at about 3000 rpm, in accordance with curve 81.

The location of the low point on minimum back pressure in the muffler of the present invention can be changed not only by hard acceleration of the engine, which effectively increases the volume of gases to the muffler, but can also be controlled by varying the volume of chamber 26. As the volume of chamber 26 is decreased, curve 81 moves toward curve 83. Thus, the curve 83 is both a hard acceleration curve and the curve which would be generated from a muffler having a counterflow chamber 26 which was somewhat smaller than the chamber of the muffler which generated curve 81. Conversely, curve 87 shows the shift to the right of the minimum back pressure that will accompany an increase in the volume of chamber 26. Thus, the muffler of the present invention can be formed with a counterflow chamber having a volume that is selected to enhance engine performance, as well as reduce noise level and weight.

It is generally preferable to vary the length of chamber 26, rather than the diameter, because the weight of the muffler does not increase as rapidly and length can usually be more easily accommodated than increased diameter. Accordingly, chamber 26 preferably is elongated and has a length selected to produce minimum back pressure at a volume of gases passing therethrough equal to the volume produced by the internal combustion engine to which the muffler has been attached when operating under nominal or most frequently expected operating conditions. For a 300 cubic inch V-8 engine, annular chamber 26 preferably has a length equal three to four times the diameter of the inlet tube 22 and an area equal to about three times the area of the inlet tube. Thus, there is about one unit of area equal to the area of inlet tube 22 for the flow of stream 36, about one unit of area for the flow of stream 47, and about one unit of area for expansion and eddy currents 48.

EXAMPLES

The advantages of the muffler of the present invention can best be illustrated by comparative data. All tests were conducted on a FORD FAIRMONT having a 302 cubic inch displacement V-8 engine. Six mufflers were tested. The first was a FORD muffler, as it comes from the factory. The second two mufflers are mufflers produced in accordance with my prior U.S. Pat. No. 3,710,891. This muffler construction represented a substantial step forward in the reduction of the weight, diameter, and noise reduction capabilities of a muffler, as compared to conventional mufflers. Two sizes of this muffler that were tested, namely, a four-inch diameter muffler and a five-inch diameter muffler. The last three mufflers tested were mufflers constructed in accordance with the present invention and having four and five inch diameter casings. The two five inch diameter mufflers were formed in accordance with FIG. 1, with the exception that casing 21 was perforated and a further outer solid casing was added which was one inch in diameter greater. The annular space between the two casings was filled with ceramic noise deadening material in one muffler and left empty in the other. Such a surrounding of a muffler with ceramic sound deadening material is well known and is employed in my prior U.S. Pat. No. 3,710,891.

Three tests were conducted. The first was a static noise level test in which the noise was measured by a decibelmeter on the "A" scale, with the microphone positioned 20 inches from the tailpipe at a 45 degree angle, as is conventionally done in measuring muffler noise levels. The engine was operated at 3000 rpm. In a second noise level test, the S.A.E. drive-by test, noise level was measured by a low range microphone from 50 feet as the automobile drove by the test stand. The procedure was in accordance with the S.A.E. J986 Testing Procedure. Finally, the back pressure, in inches of mercury, was measured under hard acceleration by accelerating the engine from 2500 to 4000 rpm and reading the back pressure at 4000 rpm.

The results of these tests can be seen in Table 1.

TABLE 1

| MUFFLER | DIAMETER (Inches) | WEIGHT (lbs.) | NOISE LEVEL "A" SCALE-3000 rpm (decibels) | NOISE LEVEL S.A.E. DRIVE-BY (decibels) | BACK PRESSURE at 4000 rpm (inches of mercury) |
|---|---|---|---|---|---|
| 1. Ford-Stock | 5 × 12 (oval) | 17 | 90 | 79.88 | 12 |
| 2. U.S. Pat. No. 3,710,891 | 4 | 9.5 | 92 | 79.25 | 11.4 |
| 3. U.S. Pat. No. 3,710,891 | 5 | 11.5 | 89.5 | 77.8 | 12.2 |
| 4. Counterflow with ceramic | 5 | 9.6 | 89 | 76.75 | 12 |
| 5. Counterflow Figure 1-3 | 4 | 4.8 | 89.5 | 77.13 | 10 |
| 6. Counterflow with ceramic removed | 5 | 6.75 | 85 | 75.7 | 8.8 |

Table 1 reveals some interesting performance characteristics of the muffler of the present invention, as compared to prior art mufflers. First, the muffler of the present invention, in a five-inch diameter casing without the ceramic liner, produced the quietest noise levels. While the "A" scale reading was the lowest, there was a 100 cycle per second noise that was too loud for some applications. The addition of ceramic to the five-inch diameter muffler eliminated the 100 hz. objectionable noise, however, the noise level was only marginally reduced below that achieved by the four-inch diameter muffler as shown in FIGS. 1-3.

The use of a ceramic liner with the muffler of the present invention, however, has several adverse effects. First, the diameter and the weight of the muffler are materially increased over that of the muffler FIGS. 1-3. Secondly, there is a substantial increase in back pressure over that of the counterflow muffler FIGS. 1-3. It is believed that the ceramic material causes a general elevation in the temperatures of the gases in the muffler, which significantly increases back pressure. Although data are not available, this back pressure increase will almost certainly be accompanyied by a fuel efficiency decrease in performance of the engine.

As between the ceramic and non-ceramic versions of the mufflers of the present invention, the smaller diameter, non-ceramic muffler, as illustrated in FIGS. 1-3, has a performance which does not have an objectionable noise level at 100 hz., is significantly lighter in weight, and has low sound levels and back pressure. Moreover and more importantly, all of the counterflow mufflers of the present invention have performance characteristics which are very substantially improved over both the muffler of my prior U.S. Pat. No. 3,710,891 and a FORD muffler. Generally, the noise levels in the muffler of the present invention are as good or lower than any of the other mufflers, the weight is significantly less, and the back pressure is significantly reduced.

To better understand the significance of weight reduction and simplicity of design of a muffler, the cost of materials in a stock muffler is about $3.40 while the cost of materials in the four-inch diameter muffler of the present invention is about $0.96. There is a 72% reduction in the raw materials employed, and since muffler metal is contaminated by the exhaust, it cannot be recycled. If every stock muffler on passenger automobiles in the United States was replaced by the muffler of the present invention, it is estimated that about 500,000,000 pounds of steel annually could be saved.

The details of construction of the counterflow chamber 26 of the four-inch diameter muffler are summarized in Table 2.

TABLE 2

| | INCHES |
|---|---|
| COUNTERFLOW CHAMBER (26) | |
| Inside Diameter (O.D. tube 22) | 2 |
| Outside Diameter (I.D. casing 21) | 3⅞ |
| Length (Port 37 to End Wall 41) | 6½ |
| CUP MEMBER (28) | |
| Inside Diameter | 3¼ |
| Spacing from inlet tube | 1 |
| Annular Port (37) | |
| Inside Diameter | 2 |
| Outside Diameter | 2⅞ |
| Outside Diameter of Expansion Section (51) | 2 5/16 |

The sound level measurements on scale "A" are in fact a composite type of measurement in which the noise levels at various frequencies are averaged together. Scale "A" is accurate for 1000 cycles per second, but the noise entrained in the exhaust gases will have various components at various frequencies. In some instances, the overall noise level, as measured on scale "A", will be entirely satisfactory, and in fact greatly improved over prior mufflers, but there will still remain a component of that noise at a specific frequency which may be objectionable. Thus, while the scale "A" reading may be below 90, the noise emanating from the muffler may have a 100 cycle per second component which is undesirably loud, as for example was the case for the five-inch diameter muffler without ceramic liver.

The muffler of the present invention is amenable to the use of a reactive type of muffler construction to eliminate specific noise components. Thus, as may be seen in FIG. 1, chamber 33, connected by tubular member 32 to cup 28, is shown in axial alignment with the inlet tube 22. This chamber is known in the industry as a Helmholtz chamber. The function of the Helmholtz chamber is that of a reactive component in that gases entering chamber 23 and the turbulence created therein cause the generation of a sound wave that is reflected back up the inlet pipe, as indicated by broken lines 91. This reflected noise can be used to cancel an objectionable noise component in the exhaust gases.

For many applications, the provision of a Helmholtz chamber as part of the muffler of the present invention is not desirable, nor is it required to obtain the enhanced performance of the muffler of the present invention. The performance data of Table 1 for the muffler of the present invention was generated by testing mufflers which did not have Helmholtz chambers. The addition of this chamber, however, can be used to tune out "low-end rumbles" or "high-frequency whistles".

The muffler and method of the present invention, therefore, enable a very significant reduction in weight while maintaining and even lowering the noise level emitted from the muffler, as compared to prior art mufflers. Moreover, the muffler of the present invention achieves this noise and weight reduction without any increase in back pressure or decrease in engine efficiency. In fact, these reductions are achieved with an attendant decrease in back pressure and increase in engine efficiency.

What is claimed is:

1. A lightweight small diameter muffler for internal combustion engines or the like including an outer elongated imperforate casing, an inlet tube mounted to said casing and extending internally thereof for the flow of exhaust gases into said muffler, an outlet tube mounted to said casing and extending therefrom for the flow of said gases from said casing, a cup-like partition means mounted inside said casing for discharge of gases from said inlet tube into said cup-like partition means, said casing and said inlet tube defining an annular elongated expansion chamber in said casing proximate and in flow communication with said cup-like partition means for discharge of gases from said cup-like partiton means into said chamber, and passageway means from said chamber to said outlet tube, wherein the improvement in said muffler comprises:

said inlet tube being imperforate;

said cup-like partition means and said inlet tube being formed to provide an annular nozzle for discharge of gases into said chamber in an annular first stream portion directed against and along the outside surface of said inlet tube;

said casing being formed with an inside surface parallel to said outside surface of said inlet tube over substantially the entire length of said chamber, and said casing being formed with a flow reversal surface at an end of said chamber remote from said cup-like partition means, said flow reversal surface extending radially from a position proximate said inlet tube to a position proximate said inside surface of said casing wall and being formed for controlled flow of said gases in a stream from said annular first stream portion to an annular second stream portion moving along said inside surface of said casing in an opposite direction and concentric with said annular first stream portion, said chamber being further formed for concentric side-by-side flow in said chamber of said first annular stream portion and said second annular stream portion without partition means interposed in said chamber between the stream portions.

2. The lightweight muffler as defined in claim 1 wherein, said cup-like partition means terminates in an inwardly tapered section formed to reduce transverse velocity components in said stream discharged into said chamber and formed to direct said stream against said inlet tube.

3. The lightweight muffler as defined in claim 2 wherein, said inlet tube is formed with an expansion section proximate the discharge end thereof, and said tapered section and the outside surface of said expansion section of said tube are cooperatively formed for the discharge of gases in an annular stream along said inlet tube.

4. The lightweight muffler as defined in claim 1, and a second chamber inside said casing at an end of said casing opposite to the location of the first named chamber, passageway means connecting said first named chamber to said second chamber said second chamber being formed for flow reversal of the direction of flow of said gases entering therein and for maintenance of said gases in a stream throughout said second chamber by directing said gases against peripheral walls defining said chamber, said chamber being uninterrupted intermediate said peripheral walls for flow of portions of said stream in side-by-side flow communication in opposite directions in said second chamber.

5. A lightweight muffler including an outer substantially imperforate casing having an inlet tube formed for the flow of gas into said casing and an outlet tube formed for the flow of gas from said casing, and partition means provided inside said casing and defining with said casing a flow chamber and passageway means communicating therewith for the flow of gas from said inlet tube to said chamber and from said chamber to said outlet tube, wherein the improvement in said muffler comprises:

said inlet tube extending concentrically into said casing to form an annular chamber between the outer surface of said inlet tube and the inside surface of said casing, said outer surface of said inlet tube and said inside surface of said casing being substantially parallel to each other over the entire length of said chamber, said inlet tube being further imperforate over the length of said chamber;

said partition means being formed as a cup-like member having a convergently tapered section providing with said inlet tube an annular nozzle for discharge of gases into said annular chamber in an annular stream directed against said outside surface of said inlet tube for flow of said gases along said outside surface over the length of said chamber;

said casing being formed for reversal of and direction of the flow of said gas against the inside surface of said casing;

whereby said gas flows throughout said chamber in a continuous annular stream with an inner annular first portion of said stream flowing in unrestricted side-by-side flow communication with a concentric outer annular second portion of said stream moving in an opposite direction to said first portion.

6. The lightweight muffler as defined in claim 5 wherein, said chamber is formed to have a length at least about equal to three times the diameter of said inlet tube and a cross section area about equal to three times the area cross section of said inlet tube for expansion of said gases and slowing of the flow rate of said stream in said chamber.

7. The lightweight muffler as defined in claim 5 wherein, at least one of said partition means and said casing are formed to provide a second chamber in said casing and to connect said second chamber to the first named chamber by said passageway means for the flow of gases from the first named chamber to said second chamber, said passage means including means to direct the flow of gas against the inside surface of said casing, said second chamber being formed for reversal of the direction of flow of said gases therein including means to direct the flow of gases against the wall of said outlet tube, whereby the flow of said gases throughout said second chamber is in a continuous stream with a first portion of said stream in said second chamber flowing in unrestricted side-by-side flow communication with a second portion of said stream flowing in said second chamber.

8. A lightweight small diameter muffler for internal combustion engines or the like including an outer elongated imperforate casing, an inlet tube mounted to said casing and extending internally thereof for the flow of exhaust gases into said muffler, an outlet tube mounted to said casing and extending therefrom for the flow of said gases from said casing, a cup-like partition means mounted inside said casing for discharge of gases from said inlet tube into said cup-like partition means, said casing and said inlet tube defining a first annular elongated expansion chamber in said casing proximate and in flow communication with said cup-like partition means for discharge of gases from said cup-like partition means into said first chamber, a second chamber inside said casing at an end of said casing opposite to the location of said first chamber, and passageway means connecting said first chamber to said second chamber, wherein the improvement in said muffler comprises:

said passageway means includes deflector means formed to discharge said gases from said passageway means in an annular stream directed against the inner surface of a portion of said casing defining said second chamber.

9. The lightweight muffler as defined in claim 8 wherein, said casing is formed with a flow reversal surface defining an end of said second chamber remote of deflector means, said flow reversal surface being formed to direct flow of said gases in an annular stream against and along said outlet tube.

10. The lightweight muffler as defined in claim 9 wherein, said outlet tube extends into said casing to a position proximate said deflector means, and said outlet tube terminates in an end remote from said flow reversal surface and having a plurality of perforations formed for communication of gases from said second chamber to said outlet tube.

* * * * *